United States Patent [19]

Wymore et al.

[11] 4,402,355

[45] Sep. 6, 1983

[54] PROTECTIVE CONTAINER FOR SNOW SKIS

[76] Inventors: Craig A. Wymore, 6840 Cherry, Kansas City, Mo. 64131; Neal F. Semrad, 835 Sherborne Ave., Los Angeles, Calif. 90035

[21] Appl. No.: 301,295

[22] Filed: Sep. 11, 1981

[51] Int. Cl.[3] ..... B65D 81/02

[52] U.S. Cl. ..... 150/52 R; 206/315 R; 206/522

[58] Field of Search ..... 206/315 R, 521, 522, 206/523, 524, 584, 591, 594; 150/52 R, 52 F

[56] References Cited

U.S. PATENT DOCUMENTS

| | | | |
|---|---|---|---|
| 1,949,677 | 3/1934 | Crawford | 150/52 F |
| 2,035,427 | 3/1936 | Goldstein | 150/52 R |
| 3,336,961 | 8/1967 | Welsh . | |
| 3,737,171 | 6/1973 | Becker . | |
| 3,767,036 | 12/1974 | McLeod . | |
| 3,851,689 | 12/1974 | Kohls | 150/52 R |
| 3,896,981 | 7/1975 | Purple . | |
| 3,909,031 | 9/1975 | Schmaedeke et al. . | |
| 3,948,436 | 4/1976 | Bambara | 206/523 X |
| 4,126,254 | 11/1978 | Sahakian . | |
| 4,131,289 | 12/1978 | Maller . | |
| 4,161,268 | 7/1979 | Heil | 206/315 R |
| 4,262,801 | 4/1981 | Avery | 150/52 F X |

*Primary Examiner*—Donald F. Norton

*Attorney, Agent, or Firm*—Litman, Day & McMahon

[57] ABSTRACT

A protective container for snow skis is provided comprising an elongate body having inner and outer wall members fabricated of a pliable material and which are retained in spaced apart relationship by a resiliently deformable cushion member placed therebetween with the inner wall defining a compartment for receipt of a set of snow skis therein. The inner and outer walls can include therebetween bladders made of an airtight material allowing pressurized air to be forced thereinto to function as the cushioning material. A sock comprising a single layer of pliable material is placed over the snow skis to facilitate the placement of the skis into the container.

15 Claims, 11 Drawing Figures

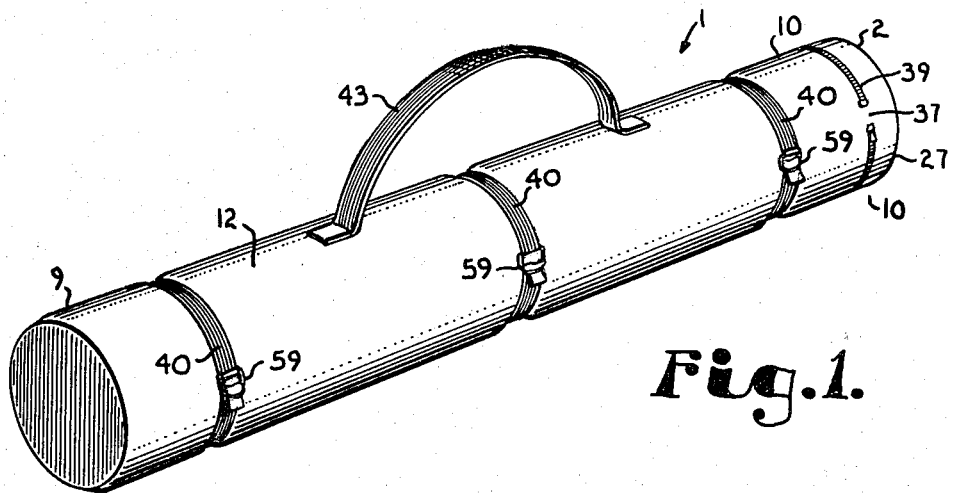
Fig. 1.
Fig. 2.
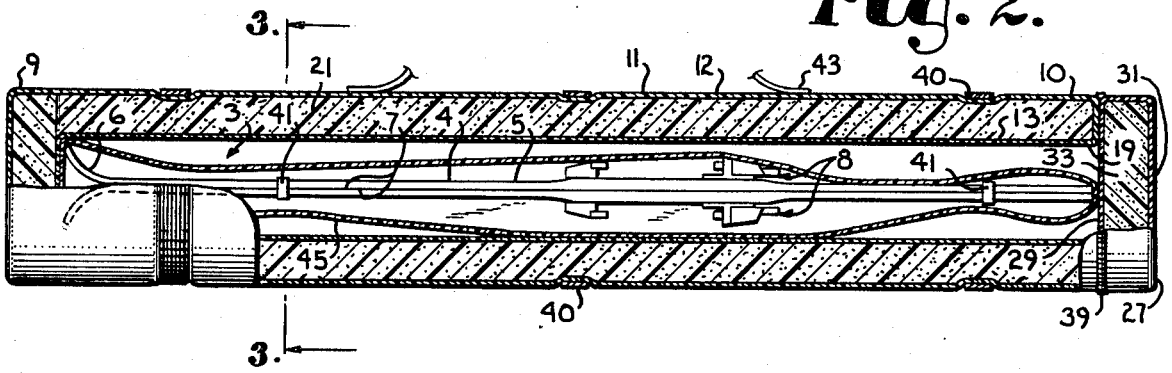
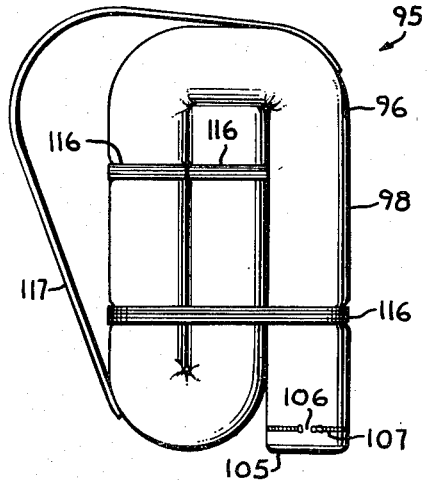
Fig. 11.
Fig. 3.
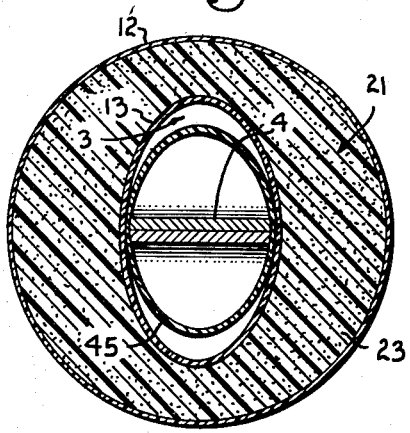

Fig. 4.
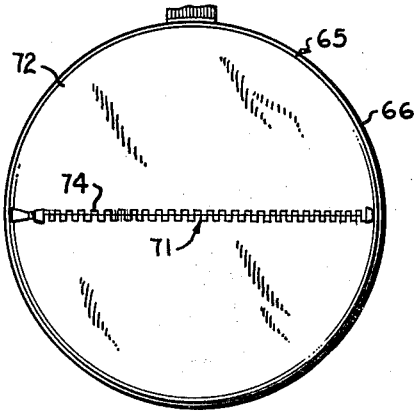
Fig. 7.
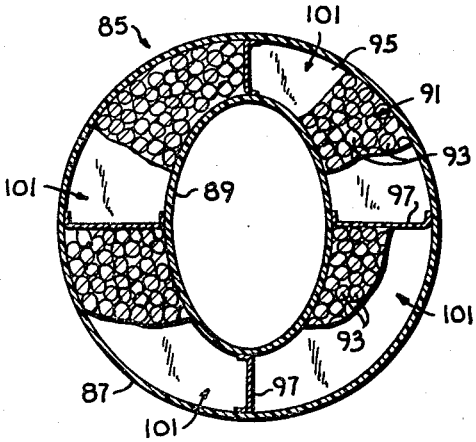
Fig. 5.
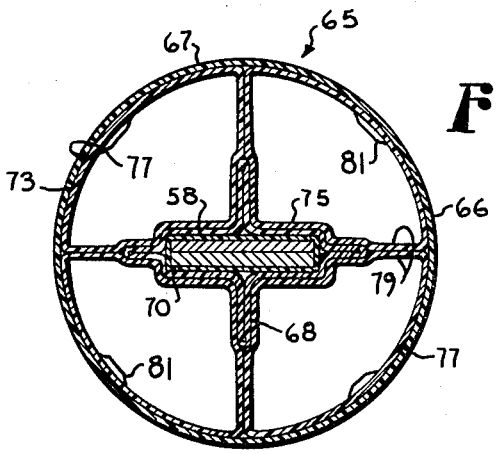
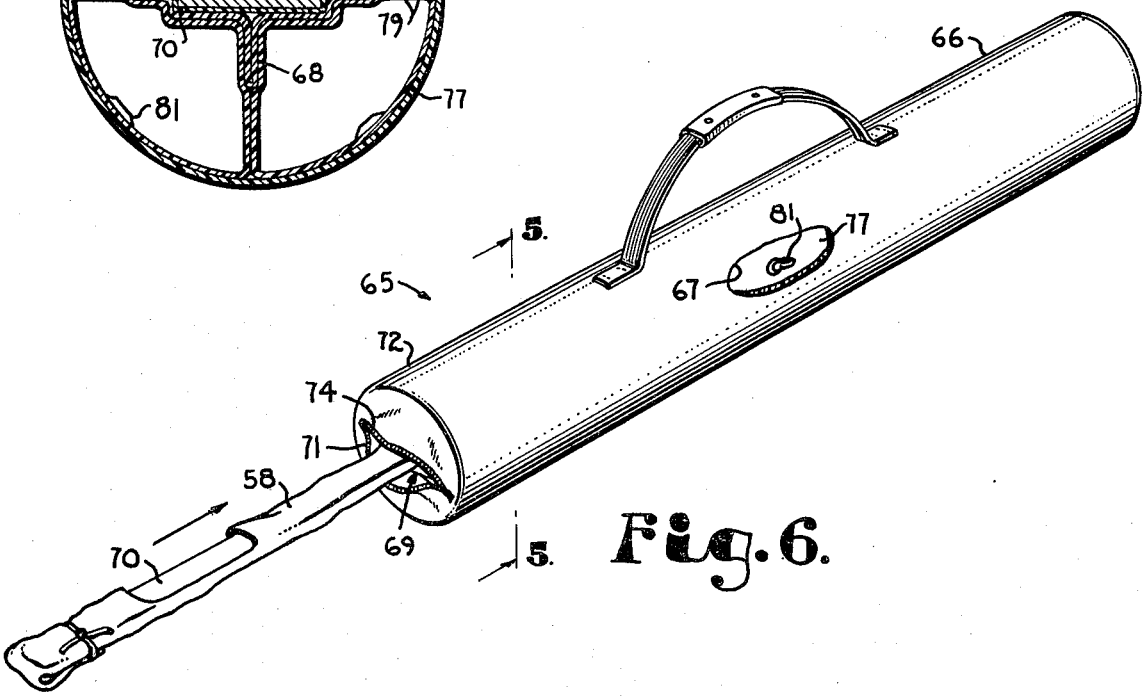
Fig. 6.

PROTECTIVE CONTAINER FOR SNOW SKIS

BACKGROUND OF THE INVENTION

This invention relates generally to containers for snow skis and in particular to protective containers for snow skis which are generally pliable as to be at least partially foldable.

Snow skiing is increasing in popularity as a winter recreational pastime. Skis can usually be rented at a ski resort, but because of this increase in popularity, many people are owning their own skis. One reason for the personal ownership of skis is that an individual can be assured of the quality and finish of his skis which is important not only for the appearance of the skis but also in their performance. Since most ski areas are located at a distance from a majority of the skiers, it is usually necessary for a ski owner to transport his skis to the ski area. Further, at ski resorts or the like, it is not uncommon for accomodations to be a considerable distance from the slopes necessitating a further carrying of the skis.

In order to preserve the finish and facilitate the handling of the skis when transporting them, it is preferable to enclose the skis in a container which will protect the skis from harmful contact with objects which would damage their finish. This is particularly true when a skier utilizes a common carrier such as a bus line, airline or the like, to travel to the ski area. However, the container should be compatible with the limitations of both travel by common carrier and by private automobile, because many ski trips involve such a duality of transportation. When transported by common carrier, skis are exposed to possible rough treatment by baggage handlers and are generally placed in a cargo hold with other luggage. Because of the relatively high length-to-thickness ratios of snow ski configurations, they are inherently susceptible to breakage if not properly protected. When transported by private automobile, the owner generally has more control over the axis and damage thereto is not so great a problem. However, if the skis are to be placed in racks mounted on the automobile, the protective container should be foldable so that minimal storage space is required therefor. To facilitate the transporting of snow skis by a user thereof various containers and carriers have been designed. These containers generally fall into two categories; a substantially rigid container, and a generally pliable or flexible container.

A drawback of a substantially rigid container is that even though the skis are protected from damage thereto in the form of nicks and dents, once the destination of the skier is reached, storage of the rigid container becomes a problem.

Flexible containers have historically been fabricated of a thin single layer of material such as nylon or canvas and have thus been ineffective in preventing damage to skis placed therein when the container is subjected to blows or impacts thereto.

None of the prior ski containers have incorporated the ability to protect the skis from impacts thereto while also being capable of easy storage.

OBJECTS OF THE INVENTION

Therefore, the objects of the present invention are: to provide a protective container for skis which is substantially pliable, but yet which protects the skis from damage thereto as a result of blows imparted to the container; to further provide such a container which is light in weight as to be easily portable; to provide such a container which comprises a body having inner and outer pliable wall members which are retained apart in spaced relation by a cushioning material with the inner wall member defining therein a compartment for receipt of the snow skis; to provide further such a protective container which has inner and outer wall members fabricated of an air tight material and which uses pressurized air as the cushioning material therein; to provide with such a container, a thin pliable sock to be placed over the snow skis to allow easy placement of the snow skis into the container; to further provide such a protective container which is easily storable when not in use, easy to manufacture, of durable workmanship, and particularly well adapted for the intended usage thereof.

Other objects and advantages of this invention will become apparent from the following description taken in connection with the accompanying drawings wherein are set forth, by way of illustration and example, certain embodiments of this invention.

SUMMARY OF THE INVENTION

A protective container for snow skis is provided which is designed to allow easy transporting of snow skis in a lightweight easily storable container, yet which is further designed to protect the snow skis contained therein from damage during transportation. The protective container comprises an elongate body having inner and outer walls fabricated of a pliable material such as nylon or canvas with the walls being retained apart in spaced relationship by a cushioning material such as foam rubber or particles of styrofoam. The inner wall defines a compartment therein in which the skis are retained during transporting thereof. The skis are placed in a thin sock of pliable material to allow easy placement of the skis within the container. The cushion member absorbs the force of blows imparted to the container protecting the enclosed skis from damage. The container is at least partially foldable so as to allow easy storage of the container.

The drawings constitute a part of this specification and include exemplary embodiments of the present invention and illustrate various objects and features thereof.

DESCRIPTION OF THE DRAWINGS

FIG. 1 is a perspective view of a first embodiment of a protective container according to this invention.

FIG. 2 is an enlarged, longitudinal cross-sectional view of the container showing a pair of snow skis enclosed in a sock positioned therein.

FIG. 3 is cross-sectional view of the container taken along line 3—3 in FIG. 2.

FIG. 4 is a rear elevational view of a second embodiment of a container according to the present invention.

FIG. 5 is a cross-sectional view of the second embodiment of the container showing segmented air divisions for retention of pressurized air as a cushioning material.

FIG. 6 is a perspective view of the container shown in FIG. 5, showing a pair of skis enclosed in a ski sock being placed therein.

FIG. 7 is a cross-sectional view of a third embodiment of a container according to the present invention showing styrofoam particles as a cushioning material thereof.

FIG. 11 is a side elevational view particularly showing the fourth embodiment of the container in a folded position.

DESCRIPTION OF THE PREFERRED EMBODIMENT

Figure 8:
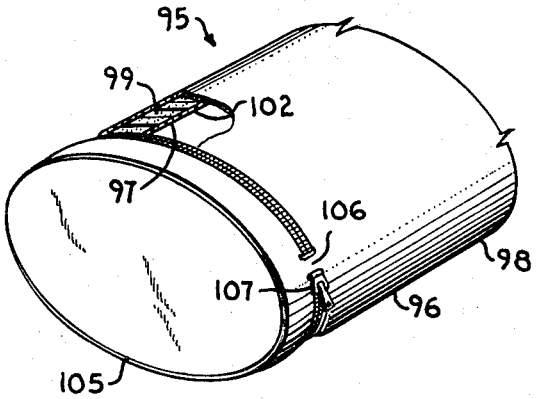
FIG. 8 is a fragmentary, enlarged perspective view of a fourth embodiment of a container according to the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a first embodiment of a protective container for snow skis according to the present invention. As best shown in FIG. 2, the container 1 comprises an elongate body 2 having a compartment 3 for the retention of a pair of snow skis 4 therein. As shown in FIG. 2, the skis are of conventional design comprising an elongate runner having a generally flat portion 5 with an upturned forward tip 6. A bottom surface 7 of the skis is generally flat. Bindings 8 are provided and retain a ski boot (not shown) each therein to secure the skis on a user thereof.

The container body 2 includes ends 9 and 10 and a medial substantially cylindrical portion 11. The body 2 further is comprised of outer and inner wall members 12 and 13 respectively. As shown in FIG. 3, the body outer wall 12 is substantially cylindrical with the inner wall 13 being generally elliptical in cross section.

As shown in FIG. 2, end 9 is enclosed while the end 10 includes an aperture 19 therethrough which communicates with the body compartment 3. Wall members 12 and 13 are fabricated of a thin, suitably pliable yet durable material such as nylon or canvas. Preferably, the walls are waterproof.

The outer wall 12 is retained spaced apart from the inner wall 13, completely surrounding the inner wall 13, by a cushioning member 21 which is positioned between the inner and outer walls. The cushioning member 21 is fabricated of a suitable lightweight resiliently deformable material such as foam rubber 23 or the like as shown in FIG. 3.

A closure member such as cap 27 is provided to selectively close the aperture 19. The cap 27 includes inner and outer walls 29 and 31 which are retained in spaced apart relationship by cushioning material 33. The cap 27 is attached to the body outer wall member 12 at a hinge line 37 and includes a closing means such as a zipper 39 as shown in FIGS. 1 and 2.

However, it will be appreciated that the ends 9 and 10 may both be provided with closure caps such as that shown at 27 or with a variety of other closure means inserted or exserted with respect to the body 2. The container body 2 includes a plurality of spaced circumferentially oriented straps 40 spaced longitudinally thereon to snug the inner body wall 13 against the skis 4 whereby the skis 4 are not free to move about within the container 1 and are thereby further protected against damage. Holders 41 are also provided that fit over the skis 4 to retain the bottom surfaces 7 of the skis in abutting relationship during transportation to further prohibit any damage thereto. A shoulder strap or handle 43 is provided to facilitate the carrying of the ski container 1.

The container 1 further includes a ski sock 45 which is formed of a thin pliable material and which is placed over the set of skis 4 prior to placement of the skis 4 into the compartment 3 of the container 1. As shown, the sock 45 is fabricated of an expandable elastic material. It is noted that by the placement of the skis 4 into the ski sock 45 prior to the placement of the skis 4 into the compartment 3, that the skis 4 are more easily placed therein as any protrusions, such as the ski tips 6 or the ski bindings 8 are prevented from catching or otherwise being obstructed from movement by contact with the inner wall 13 of the ski body 2.

As noted and seen in FIG. 2, the skis 4 are retained with the bottom surfaces 7 thereof in abutting relationship. In this orientation, the distance between the extremities of the opposed bindings 8 is approximately nine inches. Further, the distance between the opposed tips 6 is approximately eight inches and the width of the skis is approximately four inches. As shown in FIG. 3, the container compartment 3, defined by the inner wall 13 is generally elliptical in cross section having a greater axis of approximately nine inches and a lesser axis of approximately four and one-half inches. With such dimensions, the skis 4 will snugly engage the inner wall 13. Further, to effectively cushion blows to the container 1, the thickness of the cushioning member 21 is approximately two and one-half inches adjacent the greater axis of the elliptical compartment 3 and approximately four and one-half inches adjacent the lesser axis of the elliptical compartment 3. However, the cushioning member 21 may also have a substantially uniform thickness whereby the body outer wall 12 will also assume an elliptical configuration and the container 1 may be folded to a smaller size.

In use, the container cap 27 is opened by unzipping the zipper 39. Prior to inserting the skis 4 into the container compartment 3, the skis 4 are inserted into the expandable ski sock 45. Thereafter, the skis 4 and sock 45 are inserted into the compartment 3. As shown in FIG. 2, the skis 4 preferably are inserted with the tip portions 6 inserted first. After inserting the skis 4 into the compartment 3, the end cap 27 is rotated about the hinge line 37 such as to close the passageway 19. The zipper 39 is then zipped or otherwise securely closed. Each strap 40 is provided with a catch 59 or the like such that a desired amount of tension can be applied to the container body 2 by the straps 40 thereby snugging the inner wall 13 of the ski container body against the skis 4 to secure them relative to the compartment 3 preventing any movement of the skis relative to the container.

When the skis are placed thusly inside the container 1 and secured therein, the cushioning material 21 resiliently resists any transmittal of impacts which are received by the container 1 to the skis 4. Therefore, such a container 1 is particularly well suited for transporting snow skis by means of a mass transit system such as airplanes, buses, or the like. Further, if a user of the container 1 desires to rent or otherwise procure a vehicle such as a car having an exteriorly mounted ski rack for further transportation to a ski slope, the user could remove the skis 4 from the container 1 and attach the skis to the ski rack. Since the container 1 is fabricated of pliable inner and outer walls having a pliable cushioning member therebetween, the container 1 can then be substantially deformed and placed within a small enclosed area, such as a vehicle trunk, for storage.

In a second embodiment of the present invention, as shown in FIGS. 4, 5, and 6, a ski container 65 can be fabricated generally as container 1 including a body 66 having an outer wall 67 and an inner wall 68 defining therein a compartment 69 for receipt of skis 70 enclosed in ski sock 58. As shown in FIGS. 4 and 6, the container 65 includes an opening 71 in an end 72 thereof for insertion of the skis 70 thereinto. The opening 71 is selectively closable by suitable means such as a zipper 74.

Placed between the container outer and inner walls 67 and 68 are a plurality of air-tight bladders or divisions 73 each occupying a portion of the space between the container inner and outer walls 68 and 67. As shown in FIG. 5, the divisions 73 define quadrants. The divisions 73 have air bladder inner walls 75, air bladder outer circumferential walls 77 and radially-extending side walls 79 therebetween. The air bladder inner walls 75 engage the container body inner wall 68 and the air bladder outer circumferential walls 77 engage the container body outer wall 67. Preferably, the air bladder outer circumferential walls 77 are secured to the container body outer wall 67 by suitable means such as glue or the like to prevent longitudinal movement of the divisions 73 relative to the body 66. Likewise the air bladder inner walls 75 are secured to the container body inner wall 68. Also, the division side walls 79 are adhered together to prevent relative movement therewith.

In using such a container, the skis 70 are first placed in the ski sock 58 as in the prior embodiment shown in FIGS. 1 through 3 and then slid into the compartment 69. Air is forced into each division 73 through air valves 81 to inflate the divisions to an extent where they are preferably substantially rigid. The pressurized air in the divisions 73 functions as a cushioning member such as the foam rubber 23 of the embodiment shown in FIGS. 1 through 3. The container body inner wall 68 snugly engages the skis 70 to substantially occlude the potential space within the compartment 69 and to prevent any movement of the skis relative to the container 65.

After a user has reached his destination such as a ski slope, he can open all associated air valves 81 thereby releasing any pressurized air in the divisions 73 and then remove his skis 70 from the container 65. Upon doing so, the container 65 will totally deflate and will be capable of easy storage simply by folding the container 65 upon itself so as to exhibit a small volume to be stored.

A third embodiment of a protective ski container according to the present invention is shown in FIG. 7 and is generally designated by the reference numeral 85. The container 85 is substantially similar to container 1 and has outer and inner walls 87 and 89. A cushioning member 91 is placed therebetween retaining the outer and inner walls 87 and 89 in spaced apart relation. In the present embodiment, the cushioning member 91 comprises a multiplicity of small resiliently compressible particles 93 of a suitable material such as styrofoam. In order to assure that particles 93 remain substantially equally spaced about the container 85 both radial and longitudinal ribs 95 and 97 are provided extending between the outer and inner walls 87 and 89. The ribs 95 and 97 define a plurality of discrete areas 101 assuring that the particles 93 remain equally spaced about the container.

Figure 9:
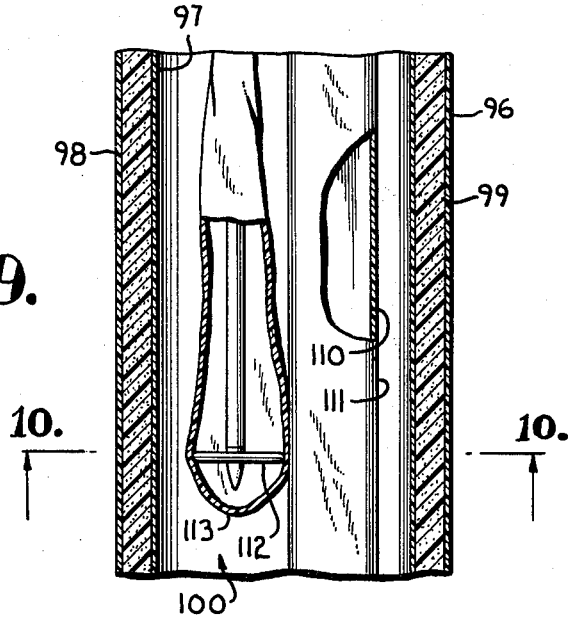
FIG. 9 is a fragmentary, enlarged longitudinal cross-sectional view of the fourth embodiment of the container particularly showing a pair of ski poles enclosed in a ski pole sock placed therein.
Figure 10:
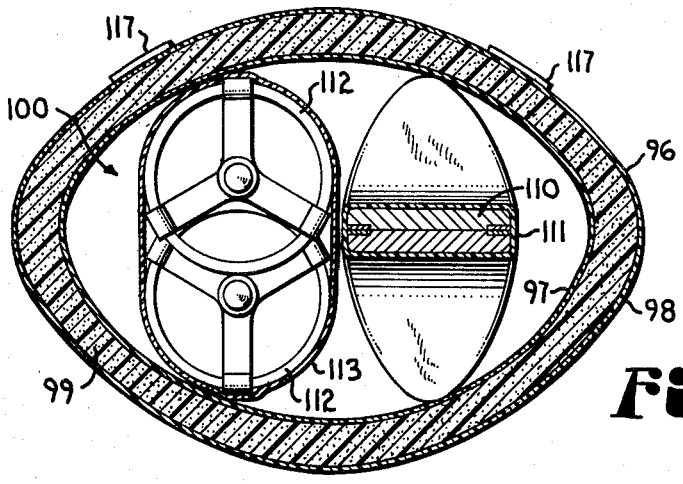
FIG. 10 is a cross-sectional view of the fourth embodiment of the container taken along line 10—10 in FIG. 9.

A fourth embodiment of a protective ski container according to the present invention is shown in FIGS. 8–11 and is generally designated by the reference numeral 95. The ski container 95 comprises a body 96 with inner and outer walls 97 and 98 respectively and cushioning material 99 therebetween. As shown in FIG. 10, the body 96 has a generally elliptical cross-sectional configuration and the inner wall 97 defines a compartment 100 having a generally elliptical cross-sectional configuration.

The cushioning material 99 has a substantially uniform thickness and also defines an elliptical cross-sectional configuration.

A cap 105 is provided at one end of the body 96 for selectively closing a passageway 102 into the compartment 100. The cap 105 is attached to the body 96 at a hinge line 106 which accomodates relative bending therebetween. A zipper 107 partially encircles the body 96 adjacent the cap 105 and terminates at either end at the hinge line 106 whereby the compartment 100 may be selectively enclosed or open by means of the cap 105.

The compartment 100 is adapted to slidably receive a pair of skis 110 placed in a ski sock 111. Also, the compartment 100 is adapted to slidably receive a pair of ski poles 112 placed in a ski pole sock 113 and positioned adjacent the skis 110 as shown in FIGS. 9 and 10.

As shown in FIG. 11, the container body 96 includes a plurality of longitudinally spaced, circumferentially oriented straps 116 thereon for snugging the inner wall 97 against the skis 110 and the ski poles 112 to tightly retain same within the compartment 100. A pair of longitudinal straps 117 are attached to the outer wall 98 and extend longitudinally with respect to the body 96.

As shown in FIG. 11, the fourth embodiment of the ski container 95 is adapted to be folded into thirds about a pair of longitudinally spaced axes extending transversely therethrough and secured by one of the circumferential straps 116 in such a folded position. Thus folded, the ski container 95 may be conveniently stored in, for example, the trunk of an automobile and may be conveniently carried by the longitudinal straps 117.

It is anticipated that the ski containers as set forth herein, containers 1, 65, 85, and 95 can be of such a length as to be compatible with skis of varying lengths.

It is to be understood that while certain embodiments of the present invention have been illustrated and described herein, it is not to be limited to the specific forms or arrangement of parts described and shown.

What is claimed and desired to secure by Letters Patent is:

1. A protective container for snow skis comprising:
(a) an enclosed elongate body member including ends thereof, said body member having spaced inner and outer walls, said walls being thin and pliable;
(b) a compartment in said body defined by said inner wall and adapted to receive therein a pair of snow skis;
(c) a passageway through one of said body ends communicating with said compartment;
(d) cap means associated with said one of said ends to selectively close said compartment;
(e) cushion means positioned between said inner and outer walls to resiliently retain said inner and outer walls in spaced relationship whereby blows impacting said outer wall are cushioned by said cushion means and are prevented from being transmitted to said skis; and (f) a ski sock adapted to be inserted into said compartment and being fabricated of a thin pliable material for placement over said snow skis prior to the insertion of said snow skis into said container compartment.

2. The container as set forth in claim 1 wherein:

(a) said compartment is substantially elliptical in cross section.

3. The container as set forth in claim 2 wherein:

(a) said skis are retained together with bottom surfaces thereof in abutting engagement with a ski boot binding of each respective ski extending outwardly therefrom;

(b) said elliptical compartment has a height which is generally equal to the distance between outer edges of said ski boot bindings; and (c) said elliptical compartment has a width generally equal to a width of said snow skis.

4. The container as set forth in claim 1 wherein:

(a) said body includes a plurality of longitudinally spaced adjustable circumferential straps; and (b) said straps include a catch to allow said straps to be placed in desired degree of tension snugging the inner wall of said body member against a pair of skis placed within said compartment.

5. The container as set forth in claim 1 wherein:

(a) said cushion means comprises foam rubber.

6. The container as set forth in claim 1 wherein:

(a) said inner and outer walls are waterproof.

7. The container as set forth in claim 1 wherein:

(a) said cushioning means comprises resiliently compressible styrofoam particles.

8. A protective container for snow skis comprising:

(a) an enclosed elongate body member including ends thereof, said body member having spaced inner and outer walls, said walls being thin and pliable;

(b) a compartment in said body defined by said inner wall and adapted to receive therein a pair of snow skis;

(c) a passageway through one of said body ends communicating with said compartment;

(d) cap means associated with said one of said ends to selectively close said compartment;

(e) cushion means positioned between said inner and outer walls to resiliently retain said inner and outer walls in spaced relationship whereby blows impacting said outer wall are cushioned by said cushion means and are prevented from being transmitted to said skis thereby;

(f) a plurality of longitudinally and radially oriented ribs extending between said inner and outer walls providing a plurality of discrete areas bounded thereby; wherein (g) said cushion means comprises styrofoam particles placed fully within each of said discrete areas; and (h) a ski sock adapted to be inserted into said compartment and being fabricated of a thin pliable material for placement over said snow skis prior to the insertion of said snow skis into said container compartment.

9. A protective container for snow skis comprising:

(a) a body member; said body member having spaced inner and outer walls fabricated of a thin pliable material;

(b) a plurality of air-tight bladders placed between said inner and outer walls engaging same;

(c) an air valve associated with and communicating air to said bladders, said air valve extending through said outer wall;

(d) a compartment in said body defined by said inner wall and adapted to receive therein a pair of snow skis;

(e) a passageway through one of said body ends to selectively close said compartment;

(f) cap means associated with said one of said ends to selectively close said compartment;

(g) cushion means positioned between said inner and outer walls to resiliently retain said inner and outer walls in spaced relationship whereby blows impacting said outer wall are cushioned by said cushion means and are prevented from being transmitted to said skis thereby; wherein (h) said cushion means comprises air retained in said bladders; and (i) a ski sock adapted to be inserted into said compartment and being fabricated of a thin pliable material for placement over said snow skis prior to the insertion of said snow skis into said container compartment.

10. A protective container for snow skis and ski poles comprising:

(a) an enclosed elongate body member including ends thereof, said body having spaced inner and outer walls, said walls being thin and pliable;

(b) a compartment in said body defined by said inner wall and adapted to receive therein a pair of snow skis and a pair of ski poles;

(c) a passageway through one of said body ends communicating with said compartment;

(d) cap means associated with said one of said ends to selectively close said compartment;

(e) cushion means positioned between said inner and outer walls to resiliently retain said inner and outer walls in spaced relationship whereby blows impacting said outer wall are cushioned by said cushion means and are prevented from being transmitted to said skis and said ski poles;

(f) said body member being foldable across a transverse axis thereof to a folded position;

(g) strap means attached to and encircling said body member in said closed position for selectively retaining said body member in said closed position; and (h) a ski sock adapted to be inserted into said compartment and being fabricated of a thin pliable material for placement over said snow skis prior to the insertion of said snow skis into said container compartment.

11. The container as set forth in claim 10 including:

(a) a zipper attached to said one end of said body member and said cap means;

(b) said zipper partially encircling said one end of said body member and selectively retaining said cap means in closing relationship with respect to said compartment.

12. A protective container as set forth in claim 10 including:

(a) said strap means comprising a plurality of circumferential straps in longitudinally spaced relationship along said body member;

(b) at least one of said straps having a length sufficient to encircle said body member in said folded position thereof.

13. A protective container as set forth in claim 10 including:

(a) said body member transverse axis being a first transverse axis;

(b) said body member being foldable along a second transverse axis longitudinally spaced from said first transverse axis;

(c) said strap means being adapted for selectively retaining said body member in its folded position with said body member folded along said first and said second transverse axes.

14. A protective container as set forth in claim 10 wherein:

(a) said body member and said compartment are substantially elliptical in cross-section.

15. The protective container as set forth in claim 10 including:

(a) a ski pole sock adapted to be inserted into said compartment and being fabricated of a thin pliable material for placement over said ski poles prior to to the insertion of said ski poles into said container compartment.

* * * * *